US006281851B1

(12) United States Patent
Tay et al.

(10) Patent No.: US 6,281,851 B1
(45) Date of Patent: Aug. 28, 2001

(54) ANTENNA ASSEMBLY AND COMMUNICATION DEVICE UTILIZING SUCH ANTENNA ASSEMBLY

(75) Inventors: Yew Siow Tay; Huan Fong Tan; Ronghui Feng, all of Singapore (SG)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/489,325

(22) Filed: Jan. 21, 2000

(51) Int. Cl.[7] ..... H01Q 1/24
(52) U.S. Cl. ..... 343/702; 343/895
(58) Field of Search ..... 343/702; 455/90

(56) References Cited

U.S. PATENT DOCUMENTS

| | | | | |
|---|---|---|---|---|
| 4,161,710 | | 7/1979 | Kakurai | 336/192 |
| 4,491,843 | | 1/1985 | Boubouleix | 343/702 |
| 5,438,339 | | 8/1995 | Itoh et al. | 343/702 |
| 5,541,610 | * | 7/1996 | Imanishi et al. | 343/702 |
| 5,861,859 | | 1/1999 | Kanayama et al. | 343/895 |
| 5,940,039 | | 8/1999 | Wang et al. | 343/702 |
| 6,046,700 | * | 4/2000 | Kitchener et al. | 343/725 |

* cited by examiner

*Primary Examiner*—Don Wong
*Assistant Examiner*—James Clinger
(74) *Attorney, Agent, or Firm*—Daniel R. Collopy

(57) ABSTRACT

A communications device with a quarter wave antenna (11) is provided with a quarter wavelength choke that is formed by a conductive coating (14) applied to the inner wall of the housing (12) to the communications device. The conductive coating (14) is electrically coupled as a ground to antenna (11) via the ground to a printed circuit board (13) and a conductive surface to a dividing wall (18) acting as a suspended base by which to support the circuit board (13). The conductive coating (14) is extended from the antenna base over a length equal to a quarter wavelength.

14 Claims, 2 Drawing Sheets

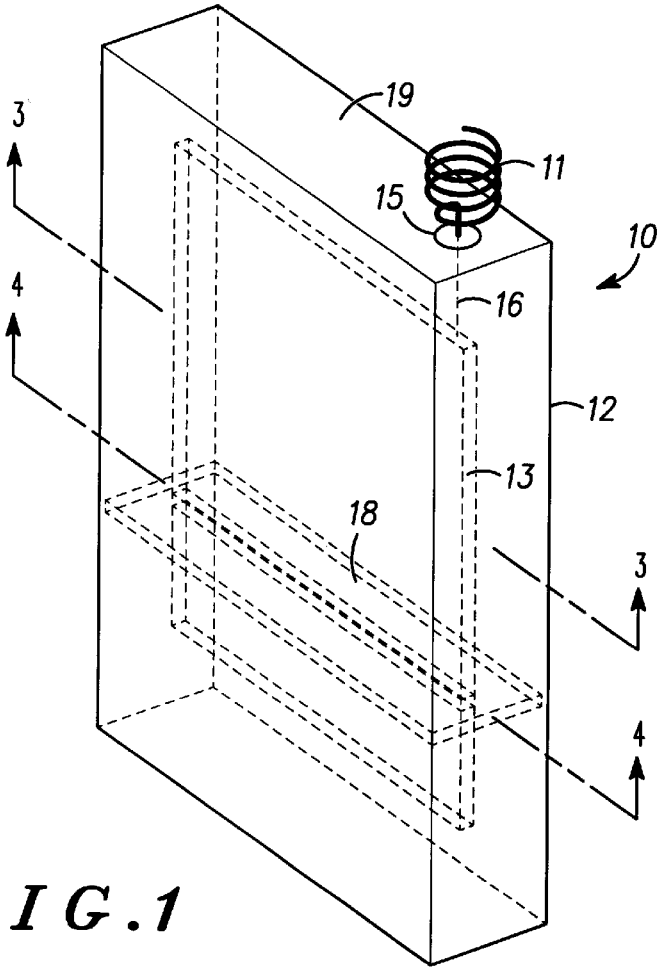
FIG.1
FIG.3
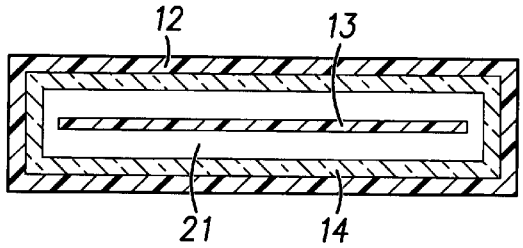
FIG.4
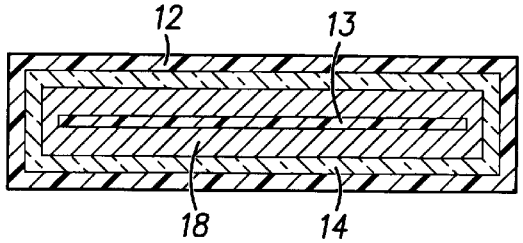

ANTENNA ASSEMBLY AND COMMUNICATION DEVICE UTILIZING SUCH ANTENNA ASSEMBLY

FIELD OF THE INVENTION

THIS INVENTION relates to an antenna assembly and a communication device operating at radio frequencies. In particular, this invention relates to a quarter wave antenna and a portable communication device operating with such an antenna.

BACKGROUND OF THE INVENTION

Radio frequency communication devices, such as two-way radios or cellular phones, are known to have circuitry to receive or transmit radio frequency signals via antennas. An example of such radio communication devices and their antenna is seen in U.S. Pat. No. 5,438,339 wherein a 'miniature high performance antenna' is realized with a retractable first portion and a fixed external second portion operative 'to promote efficient use of the limited space available in the casing'. Generally, these antennas are designed to feed desired radio frequency signals to the circuitry. The antenna is the critical element of a communication device. Its performance determines the overall efficiency of the device. The antenna is desirably small, at least during storage, in portable devices. An example of a retractable antenna is seen in U.S. Pat. No. 5,861,859 wherein is achieved an antenna assembly 'which requires a smaller housing space'.

In the art, an antenna operating at a desired radio frequency signal is said to resonate at the frequency of that signal. Short antenna lengths are desirable when the device is to be hand held. A short antenna is typically brought to resonance by loading it with an inductor. A loading coil for an antenna is described in U.S. Pat. No. 4,161,710 wherein the coil is tapped to enable selection between frequencies. A smaller antenna may be effected with a one-quarter wavelength ($\frac{1}{4}\lambda$) antenna which will resonate over a ground plane. The ground to the circuit board of the device can be used as the ground plane to the antenna.

There is a desire for smaller hand held communication devices. The printed circuit board to the devices has been made smaller and the available ground plane is consequently smaller.

There is a strong dependency of the antenna on the small ground plane which is effected within a hand held device such that further reduction of size of the communication device and consequent reduced circuit board size results in less effective ground plane to the antenna such that it is more easily de-tuned when a user holds the device. A consequence is reduced efficiency. The presence of the user results in the resonant frequency of the antenna shifting away from the desired frequency. This causes poor consistency and reliability in the performance of the device and a reduction in battery life. There is a need to alleviate the problem of antenna detuning in these communication devices, especially portable devices.

An antenna is an assembly that can include the housing of a radio communication device or some portion of that housing. For example, U.S. Pat. No. 4,491,843 describes a dipole antenna formed with a metal plate and a metal box that encloses radio circuitry and placed at a predetermined distance from the metal plate. In U.S. Pat. No. 5,940,039 is a hand held communications device in which a 'shielding case' to a loading coil changes 'the polarizing mode of the antenna' so that a user's head may be in a radiation safe area.

Whilst such conductive elements of an area extended type are known, and antennas have been developed in a range of forms as described above, there remains a problem with holding a quarter wave antenna at a desired frequency.

SUMMARY OF THE INVENTION

Accordingly, in one aspect the invention provides a communications device which includes a housing to the device having an antenna mount, a quarter wave antenna operative at a particular frequency and fitted at the antenna mount, and an electrical conductor element, wherein the electrical conductor element has a dimension at substantially a quarter of the wavelength of the particular antenna frequency and is electrically connected to the antenna ground.

In another aspect, the invention provides a radio frequency communication device comprising an electrically non-conductive housing; an antenna mount on the housing, the antenna mount having a ground connection; an antenna operative at a particular radio frequency coupled to the antenna mount; an electrically conductive element within the housing, the conductive element having a proximal end coupled to the ground connection and the conductive element extending substantially away from the antenna mount to a distal end; and an electrically conductive sleeve associated with the housing, the electrically conductive sleeve being arranged with the electrically conductive element therewithin, and the electrically conductive sleeve having a distal portion coupled to the distal end and an open portion proximal to the antenna mount.

In yet another aspect, the invention provides a radio frequency antenna assembly comprising an antenna mount having a ground connection; an electrically conductive element having a proximal end coupled to the ground connection, and the electrically conductive element extending substantially away from the antenna mount to a distal end; and an electrically conductive sleeve arranged with the electrically conductive element therewithin, the electrically conductive sleeve having a distal portion coupled to the distal end and having an open portion proximal to the antenna mount.

BRIEF DESCRIPTION OF THE DRAWINGS

In order to describe the invention and to put it into practical effect, reference will now be made to a preferred embodiment of the invention as illustrated with reference to the accompanying drawings in which:

FIG. 1 is a perspective view of a communications device;

FIG. 3 is a transverse cross-section of the communications device of FIG. 1 along line 3—3; and FIG. 4 is a transverse cross-section of the communications device of FIG. 1 along line 4—4.

DETAILED DESCRIPTION OF THE PREFERRED EMBODIMENT

Figure 2:
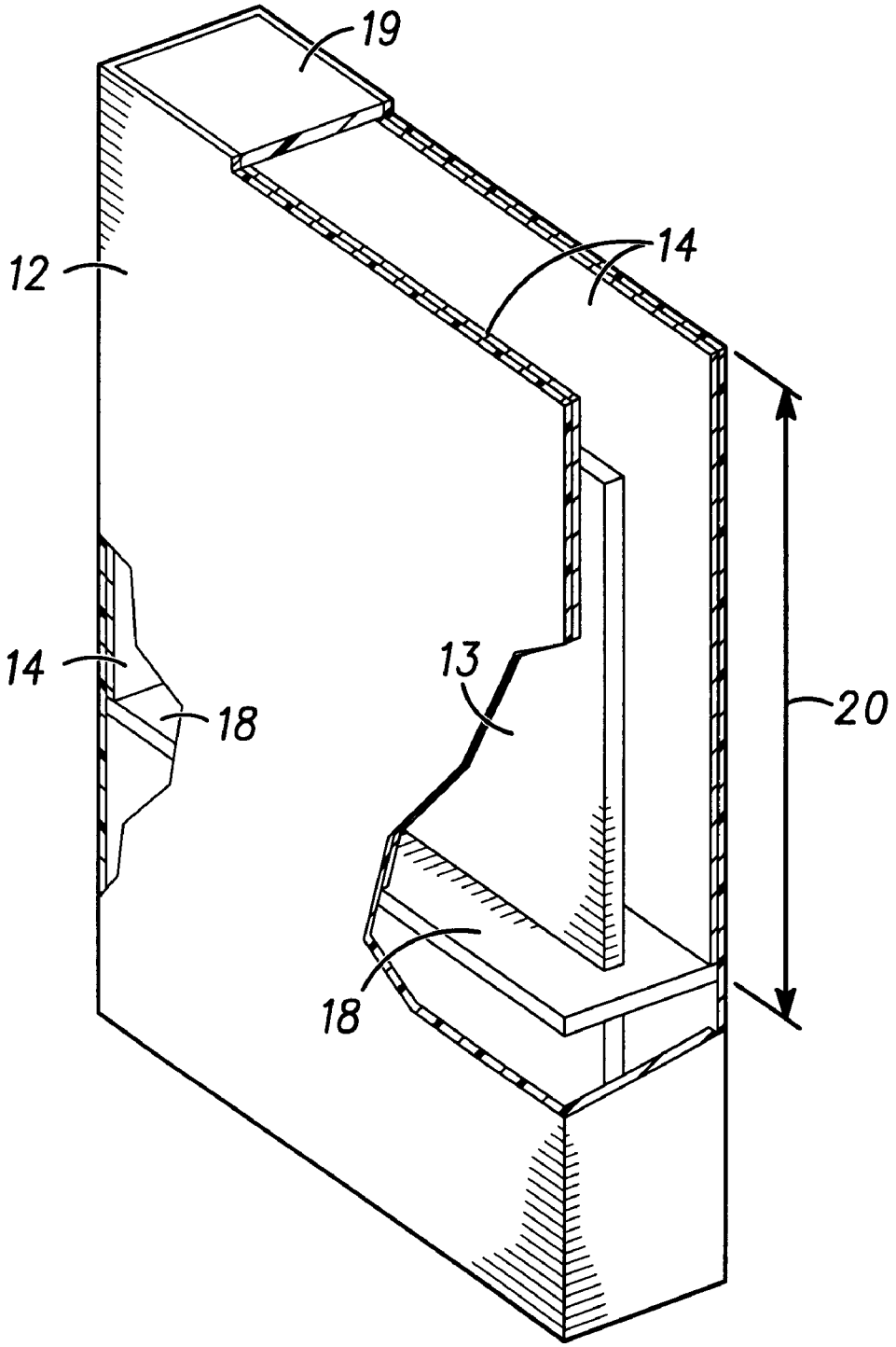
FIG. 2 is a perspective view of a communications device as in FIG. 1 with cut-away sections to show a conductive element in accordance with an embodiment of the invention.

In FIG. 1 is seen a schematic representation of a radio frequency communication device 10 having an electrically non-conductive housing 12 that contains a printed circuit board 13. The housing 12 provides an antenna mount 15 on end wall 19 at which an antenna 11 is fitted. The antenna mount 15 has a ground connection (not shown). The communication device 10 might be a two way radio, a cellular phone, or other like type device. The functions performed by the different types of communication devices are determined by the electronics which are mounted on the printed circuit board 13. These functions and their circuits are well known to those in the art and their specifics are not critical to the working of the invention. The communication device 10 will be one that receives or transmits radio frequency (RF) signals.

Referring now to FIGS. 1 and 2, a choke to the quarter wave antenna 11, that is fitted to housing 12, may comprise an electrically conductive coating 14, ideally applied to inside walls of housing 12. Antenna 11, printed circuit board 13 and conductive coating 14 are electrically connected as described below. Conductive coating 14 is readily applied to the four surrounding walls using any of the standard metal coating processes known to those skilled in the art, the end wall 19 being uncoated and readily achieved by insertion of the end wall after the coating process. Ideally the inside of housing 12 is sprayed with a conductive paint to form an electrically conductive sleeve with one end closed and coupled to the printed circuit board 13 and another end open, with the antenna mount 15 encircling the open end.

A radio frequency signal input of an antenna 11, coupled to the antenna mount 15, is electrically connected to the printed circuit board 13 by an antenna feed 16 of suitable type as will be known to those in the art. Printed circuit board 13 will be provided with ground conductors (not shown) as will be known to those skilled in the art and its ground reference can be electrically connected to conductor 14 via a conductive coating to the dividing wall 18. In addition, the ground reference of the printed circuit board 13 has a coupling point (not shown) which is coupled to the ground connection of the antenna mount 15. The dividing wall 18 acts as a suspended base by which to locate the printed circuit board 13 within housing 12.

Printed circuit board 13 can be provided with ground conductors in known manner. Typically, the ground conductors in the printed circuit board 13 are a part of a pattern of conductors, not shown, on a non-conductive supporting material, with circuit components mounted thereto and linked by the conductors. The ground conductors in the printed circuit board form an electrically conductive element. The nonconductive material and the circuit components are not shown in order to simplify FIGS. 1 and 2.

A transverse cross-section of the communications device along line 3—3 of FIG. 1 is seen in FIG. 3. Conductive coating 14 ideally surrounds printed circuit board 13 at this cross-section.

A transverse cross-section of the communications device along line 4—4 of FIG. 1 is seen in FIG. 4. Conductive coating 14 at this cross-section is ideally electrically connected to the coating on dividing wall 18.

An electrical path is conveniently provided from the ground to antenna 11 to coating 14 via printed circuit board 13 and the coating on dividing wall 18. The critical quarter wave length dimension is indicated with a two-way arrow 20 in FIG. 2. The length from antenna mount 15 to dividing wall 18 is ¼λ. In the above preferred embodiment, conductive coating 14 and printed circuit board 13 are separated by a dielectric media 21. This media can be air and/or any other compound with an appropriate permittivity.

Advantageously the quarter wave electrical conductor element 14 serves as what is referred to herein as a ¼λ choke operative to reduce effects on the antenna performance from external effects such as a user holding housing 12. Detuning of an antenna connected at antenna mount 15 is alleviated. When detuning is thus alleviated, power is more efficiently used compared to conventional radio communication devices and this provides for a longer battery life in battery-powered portable radio communication devices.

The above described quarter wave choke is readily realized without the need to make any major changes to the communication device and without addition of new components in the circuitry. It is easily integrated into the housing design. Coating an inside surface of the housing does not call for application of any new technology.

What is claimed is:

1. A communications device including:

a housing to the device, the housing including an internal dividing wall that affects the suspended base to a circuit board, having an antenna mount;

a quarter wave antenna operative at a particular frequency, fitted at the antenna mount; and an electrical conductor element;

wherein said electrical conductor element has a dimension at substantially a quarter of the wavelength of the particular antenna frequency and is electrically connected to the antenna ground.

2. The communications device as claimed in claim 1 wherein the antenna mount is at an end of the housing and said electrical conductor element is within a wall of the housing and extended substantially over a quarter wave length from said end.

3. The communications device as claimed in claim 1 wherein said electrical conductor element is formed by a coating on an internal surface of said housing, the coating being an electrically conductive material.

4. The communications device as claimed in claim 2 wherein the housing contains a circuit board and said electrical conductor element is a conductive coating to an inner wall of the housing that is electrically connected to the ground of the circuit board at a point that is distant from said end at a dimension relative to the particular antenna frequency that is substantially a ¼λ.

5. The communications device as claimed in claim 1 wherein said electrical conductor element includes at least one planar surface located alongside but spaced from a printed circuit board carrying the electronics to the communications device, electrically connected to the ground of the printed circuit board at a suspended base that supports the circuit board in the housing.

6. The communications device as claimed in claim 5 wherein the housing is a substantially rectangular enclosure with one divided off section of the enclosure having a conductive internal surface to the housing wall that is ¼λ on its side.

7. The communications device as claimed in claim 6 wherein said ¼λ surface and adjoining dividing wall surface have an electrically conductive coating applied thereto.

8. A radio frequency communication device comprising:

an electrically non-conductive housing having an internal dividing wall that affects the suspended base to the circuit board;

an antenna mount on the housing, the antenna mount having a ground connection;

an antenna operative at a particular radio frequency coupled to the antenna mount;

an electrically conductive element within the housing, the conductive element having a proximal end coupled to the ground connection and the conductive element extending substantially away from the antenna mount to a distal end; and an electrically conductive sleeve associated with the housing, the electrically conductive sleeve being arranged with the electrically conductive element therewithn, and the electrically conductive sleeve having a distal portion coupled to the distal end and an open portion proximal to the antenna mount.

9. The radio frequency communication device as claimed in claim 8, wherein the antenna mount is at an end of the housing and the electrically conductive element is within a wall of the housing and extends substantially over a quarter wave length from the end of the housing.

10. The radio frequency communication device as claimed in claim 8 wherein the housing contains a circuit board and the electrically conductive element is a conductive layer integrated with the circuit board, the circuit board having a coupling point which is coupled to the electrically conductive layer, the coupling point for coupling to the ground connection of the antenna mount.

11. The radio frequency communication device as claimed in claim 8 wherein the electrically conductive sleeve is formed by a coating on at least one internal surface of said housing, the coating being an electrically conductive material.

12. The radio frequency communication device as claimed in claim 11 wherein the distal end of the electrically conductive sleeve is electrically coupled to an electrical ground on the printed circuit board by a suspended base that supports the printed circuit board in the housing.

13. The communications devices as claimed in 12 wherein the housing is a substantially rectangular enclosure.

14. The radio frequency communication device as claimed in claim 8 wherein the electrically conductive element includes at least one planar surface located alongside but spaced from a printed circuit board carrying electronics of the radio frequency communication device.

* * * * *